US011377337B2

(12) United States Patent
Leeds et al.

(10) Patent No.: US 11,377,337 B2
(45) Date of Patent: Jul. 5, 2022

(54) BOTTLE FILLER FOUNTAIN

(71) Applicant: GLOBAL INDUSTRIAL DISTRIBUTION INC., Port Washington, NY (US)

(72) Inventors: Richard B. Leeds, Port Washington, NY (US); Bruce Zutler, Port Washington, NY (US); Phillip Lee, Port Washington, NY (US)

(73) Assignee: GLOBAL INDUSTRIAL DISTRIBUTION INC., Port Washington, NY (US)

( * ) Notice: Subject to any disclaimer, the term of this patent is extended or adjusted under 35 U.S.C. 154(b) by 0 days.

(21) Appl. No.: 17/193,295

(22) Filed: Mar. 5, 2021

(65) Prior Publication Data

US 2021/0276853 A1 Sep. 9, 2021

Related U.S. Application Data

(60) Provisional application No. 62/986,158, filed on Mar. 6, 2020.

(51) Int. Cl.
*B67D 1/00* (2006.01)
*E03B 9/20* (2006.01)

(52) U.S. Cl.
CPC ..... *B67D 1/0014* (2013.01); *E03B 9/20* (2013.01); *B67D 2210/0001* (2013.01)

(58) Field of Classification Search
CPC .. B67D 1/0888; B67D 1/0891; B67D 1/0857; B67D 1/0014; B67D 1/16; B67D 2001/009; B67D 2210/0001
USPC ..... 222/108; 137/312
See application file for complete search history.

(56) References Cited

U.S. PATENT DOCUMENTS 6,649,056 B2 * 11/2003 Fritze ..... B01D 35/147 210/315
7,677,053 B2 * 3/2010 Truitt ..... F25D 23/126 62/264
8,443,614 B2 * 5/2013 Kim ..... F25D 29/00 62/3.64
9,643,832 B2 * 5/2017 Steward ..... B67D 1/16
2003/0089423 A1 * 5/2003 Barton ..... B67D 1/00 141/198
2009/0242075 A1 * 10/2009 Busick ..... A61L 2/10 141/85
2009/0321335 A1 * 12/2009 Siemer ..... C02F 9/005 210/175
2010/0170857 A1 * 7/2010 Williams ..... C02F 9/005 210/741
2012/0006740 A1 * 1/2012 Swift, Jr. ..... B01D 35/147 210/457
2012/0104021 A1 * 5/2012 Cur ..... F25D 23/126 62/389
2013/0062366 A1 * 3/2013 Tansey ..... B67D 1/0021 222/102

(Continued)

*Primary Examiner* — Timothy L Maust
(74) *Attorney, Agent, or Firm* — Troutman Pepper Hamilton Sanders LLP

(57) ABSTRACT

A bottle filling station may include a liquid dispenser configured to dispense liquid. A pan can be configured to collect at least a portion of the dispensed liquid with a liquid flow circuit providing liquid to the liquid dispenser. A filter can be disposed in the liquid flow circuit configured to filter the liquid in the liquid circuit and a non-filtering bypass can provide liquid to the liquid dispenser bypassing the filter.

2 Claims, 13 Drawing Sheets

(56) References Cited

U.S. PATENT DOCUMENTS

| | | | | |
|---|---|---|---|---|
| 2015/0210569 | A1* | 7/2015 | Dgani | B01D 15/08 222/148 |
| 2016/0025406 | A1* | 1/2016 | An | C02F 1/003 222/143 |
| 2018/0299184 | A1* | 10/2018 | Abeygunawardana | B67D 1/16 |

* cited by examiner

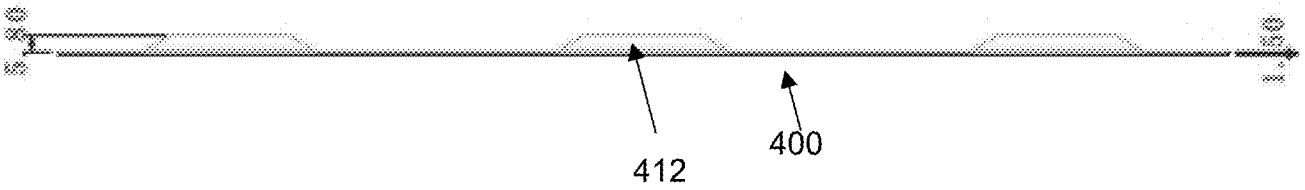
FIG. 4A
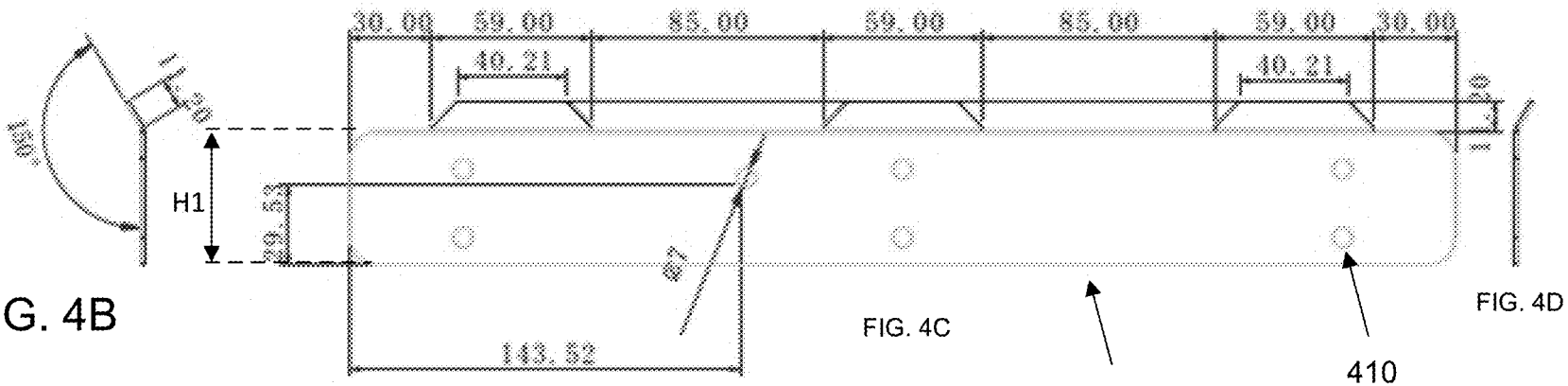
FIG. 4D
FIG. 4C
FIG. 4B
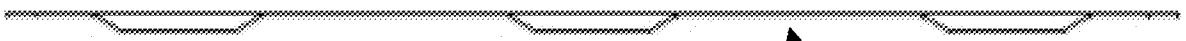
FIG. 4E

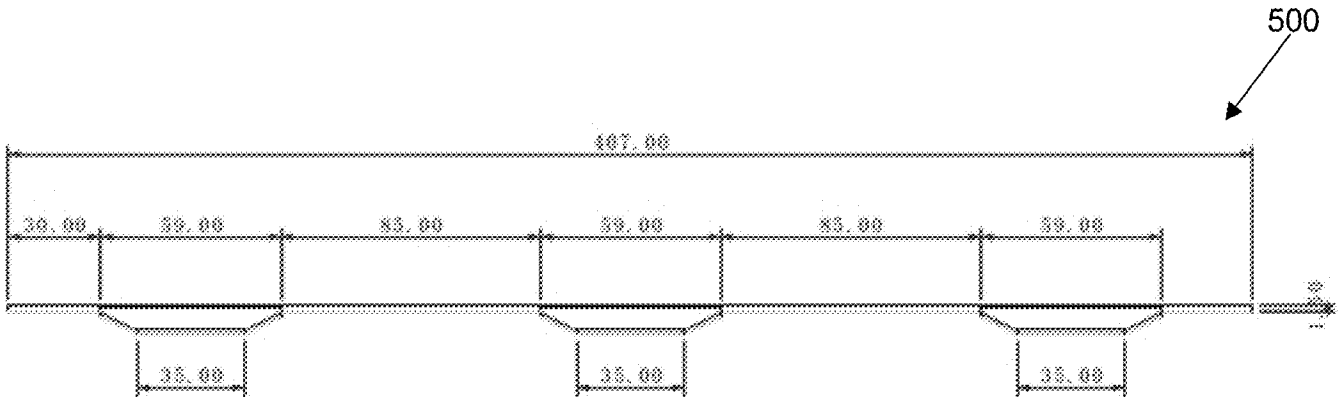
FIG. 5A
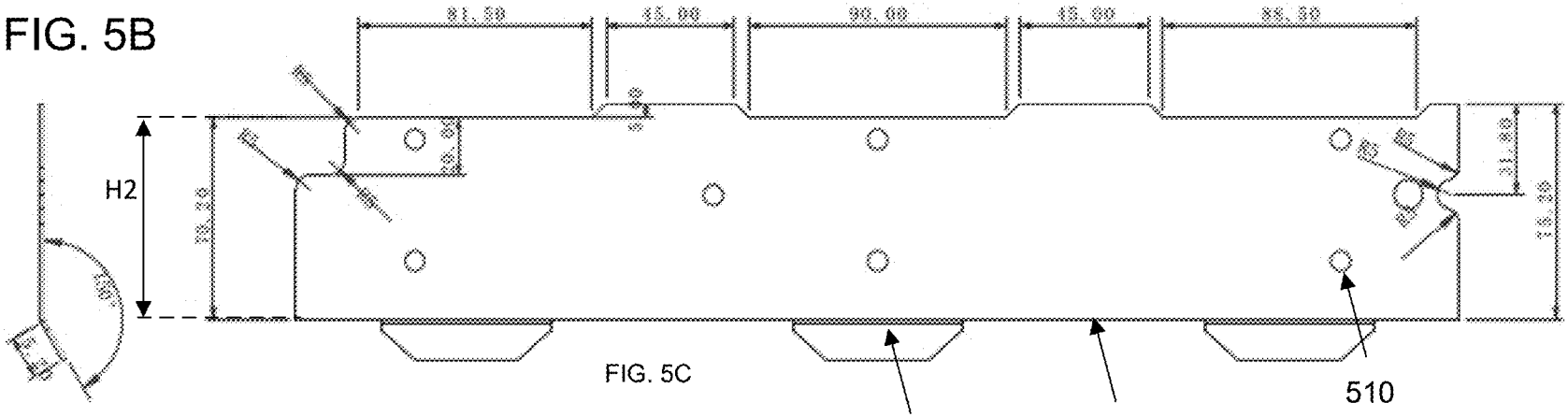
FIG. 5B
FIG. 5C

Perspective view of the lower bracket

BOTTLE FILLER FOUNTAIN

CROSS-REFERENCE TO RELATED APPLICATION

This application is a non-provisional of and claims priority to U.S. Provisional Patent Application No. 62/986,158 filed Mar. 6, 2020. This application is incorporated herein by reference in its entirety.

FIELD OF INVENTION

The present invention generally relates to a liquid dispenser station, and more particularly, to a bottle filing station for dispensing liquid based on detection of a presence of a bottle.

BACKGROUND

Existing liquid dispensers have many known issues that need improvements. For example, existing liquid dispensers typically lack a simplified, secured mechanism to engage drinking fountains to a wall. Existing bottle filling stations need an improved mechanism for detecting presence of a bottle. Existing drinking fountains and existing bottle filling stations lack a simplified, modular design for assembly purposes.

Some existing liquid dispenser stations demand a filter to be disposed in a liquid flow circuit. The filter is always provided with a radio frequency identification (RFID) tag detectable by a sensor. Absent the filter, these liquid dispenser stations do not operate. As such, there is a need for a non-filtering bypass mechanism that provides support for continuous liquid flow in the absence of the filter. Further, when the filter operates in the liquid flow circuit, there is an additional need for a mechanism to track the filter usage. Various embodiments of the disclosed technology address these needs.

SUMMARY

It is an object of the present invention to provide systems, devices, and methods to meet the above-stated needs. The disclosed technology relates to an example liquid dispenser station. The example liquid dispenser station may include a top mounting bracket that defines a first height and a plurality of first holes. The top mounting bracket may include at least one top flange. A bottom mounting bracket may define a second height and a plurality of second holes. The bottom mounting bracket may include at least one bottom flange. The second height may be different from the first height. A drinking fountain may be configured to be secured to a wall by the top flange and the bottom flange.

In one embodiment, the first height may be less than the second height. In one embodiment, the top mounting bracket may include three top flanges, and the bottom mounting bracket may include three bottom flanges.

Another aspect of the disclosed technology relates to a bottle filling station. The bottle filling station may include a liquid dispenser configured to dispense liquid, and a pan configured to collect at least a portion of the dispensed liquid. The bottle filling station may include a sensor configured to detect a presence of a liquid container. The sensor may define a height of approximately 9.25 inches relative to the pan. A controller may control the liquid dispenser to dispense liquid when the liquid container is approximately near the sensor.

In one embodiment, the pan may be positioned below the liquid dispenser. In one embodiment, the bottle filing station may include a cooling system located below the liquid dispenser. In one embodiment, the pan may include a stainless-steel basin. In one embodiment, the cooling system may include three raised arcs to support the liquid container when at rest, and direct spilled water into the basin.

In one embodiment, the sensor may include an infrared (IR) sensor for detecting the presence of the liquid container. In one embodiment, the IR sensor may include at least one of an IR photodiode, an IR light emitting diode (LED), and associated electrical circuitry for receiving IR signals from the IR photodiode and transmitting light from the IR LED. In one embodiment, the IR sensor may detect the presence of the liquid container by performing the following: (1) receiving a first, environmental IR signal from the IR photodiode while the IR LED is not transmitting light; (2) receiving a second, detection signal from the IR photodiode while the IR LED is transmitting light, and (3) comparing an intensity of the first, environmental IR signal to an intensity of the second, detection signal to determine whether the second, detection signal is emitted from the environment or is reflected from the liquid container.

In one embodiment, the bottle filing station may include a non-transitory storage medium configured to store a sensitivity level. In one embodiment, the sensitivity level may be manually set via a setting menu to a value between 1 and 10. In one embodiment, the sensor may detect the presence of the liquid container based on a first difference between the intensity of the first, environmental IR signal and the intensity of the second, detection signal when the sensitivity level has a first value. The sensor may detect the presence of the liquid container based on a second difference between the intensity of the first, environmental IR signal and the intensity of the second, detection signal when the sensitivity level has a second value. The first value may be less than the second value. The first difference may be less than the second difference.

In one embodiment, once the liquid container is detected, the sensor may not change a detection result even if the liquid container moves within a sight of the sensor such that the liquid container is still positioned to reflect the IR signal transmitted from the IR LED with a sufficient intensity.

In one embodiment, the sensor may complete detection of the liquid container within one second from a moment that the liquid container becomes present. In one embodiment, the sensor may repeatedly perform detection.

In one embodiment, the controller may be configured to continuously generate a zero-level signal value corresponding to a clear field of view. The controller may calculate the zero-level signal value from multiple readings of the sensor. In one embodiment, the controller may open and close a bottle filling water valve based on the detection by the sensor.

In one embodiment, the bottle filling station may include an LED activated to illuminate a bottle filling area, when the bottle filling water valve is open.

In one embodiment, the bottle filling station may include a counter configured to track and display a number of theoretical bottles saved from being landfilled by refilling at the bottle filling station. In one embodiment, the counter may be based on quantity of liquid that flows through the bottle filling station. In one embodiment, the counter may increment when every 16 oz of liquid has flowed through the bottle filling station.

In one embodiment, the bottle filling station may include a filter where the liquid to be dispensed passes therethrough.

In one embodiment, the bottle filling station may include a filter status light indicating a status of the filter.

In one embodiment, the bottle filing station may include a bottle filling area illustrating a bottle and a bullseye type target where the sensor is positioned.

A further aspect of the disclosed technology relates to a modular assembly of a drinking fountain. The modular assembly may include a first preassembled module including a cooling system, and a second preassembled module including a pan assembly. The first module and the second module may include a first attachment and a second attachment respectively for coupling to each other during installation. During installation, the first and second modules may be readily secured to the wall.

In one embodiment, the cooling system may include a stain steel container. In one embodiment, the cooling system may be positioned below the pan assembly when installed. The pan assembly may include a hood. The hood may include a semi-pliant material deformable on contact.

In one embodiment, the pan assembly may include a stainless-steel basin. In one embodiment, the pan assembly may define a flat sloping pan shape. In one embodiment, the pan assembly may comprise a drain.

An additional aspect of the disclosed technology relates to a modular assembly of a bottle filling station. The modular assembly may include a first preassembled module including a cooling system, and a second preassembled module including an assembly having a pan and a bottle filler. The first module and the second module may include a first attachment and a second attachment respectively for coupling to each other during installation. During installation, the first and second modules may be readily secured to the wall.

Yet another aspect of the disclosed technology relates to a liquid dispenser station. The liquid dispenser station may include a liquid flow circuit, and a non-filtering bypass cap disposed in the liquid flow circuit at a filter's position when the filter is removed. The non-filtering bypass cap may have a physical dimension identical to that of the filter. The non-filtering bypass cap may be removably attached to the liquid flow circuit via a thread engagement. The non-filtering bypass cap may be configured to allow liquid to flow therethrough.

In one embodiment, the non-filtering bypass cap is devoid of a radio-frequency identification (RFID) tag.

A further aspect of the disclosed technology relates to a liquid dispenser station. The liquid dispenser station may include a DC power supply, a pan coupled to a first liquid dispenser powered by the DC power supply to dispense liquid, and a bottle filler coupled to a second liquid dispenser powered by the DC power supply to dispense liquid.

An additional aspect of the disclosed technology relates to a liquid dispenser station. The liquid dispenser station may include a liquid dispenser for dispensing liquid, a filter sensor and a flow trigger. The filter sensor may be in fluid communication with the liquid dispenser. The filter sensor may be configured to track an amount of the liquid that has passed through a filter. The flow trigger may activate the liquid dispenser to dispense the liquid and indicate a usage of the filter.

In one embodiment, the flow trigger may have at least one of the following configurations: a bumper button, a push bar, and a valve button. In one embodiment, the flow trigger may include a filter meter displaying the usage of the filter. In one embodiment, the flow trigger may include an LCD display that uses five colors to indicate the usage of the filter. In one embodiment, the filter may be configured to remove or reduce at least one of the following: chlorine, odors, lead and cysts. In one embodiment, the filter may be NSF/ANSI 42 and 53 complaint. In one embodiment, the filter may have a unique threading engagement. In one embodiment, the filter may be configured to perform a maximum of 3000-gallon filter cycles. In one embodiment, the usage of the filter may be determined based on a length of time of using the filter. In one embodiment, the filter may have a usage life term of 90 days.

Another aspect of the disclosed technology relates to a method for detecting a presence of a liquid container by a bottle filling station. The method may include receiving a first, environmental IR signal from an IR photodiode disposed on the bottle filling station, while an IR LED disposed on the bottle filling station is not transmitting light. A second, detection signal may be received from the IR photodiode while the IR LED is transmitting light. A controller of the bottle filling station may compare an intensity of the first, environmental IR signal to an intensity of the second, detection signal to determine whether the second, detection signal is emitted from the environment or is reflected from a bottle. The controller may determine a presence of the bottle after determining that the second, detection signal is reflected from the bottle. The controller may control a liquid dispenser of the bottle filling station to dispense liquid after determining the presence of the bottle.

Various aspects of the described example embodiments may be combined with aspects of certain other example embodiments to realize yet further embodiments. It is to be understood that one or more features of any one example may be combined with one or more features of the other example. In addition, any single feature or combination of features in any example or examples may constitute patentable subject matter. Other features of the technology will be apparent from consideration of the information contained in the following detailed description.

BRIEF DESCRIPTION OF THE DRAWINGS

The above and further aspects of this invention are further discussed with reference to the following description in conjunction with the accompanying drawings, in which like numerals indicate like structural elements and features in various figures. The drawings are not necessarily to scale, emphasis instead being placed upon illustrating principles of the invention. The figures depict one or more implementations of the inventive devices, by way of example only, not by way of limitation.

FIG. 4A illustrates a top view of a top mounting bracket according to aspects of the present invention.

FIGS. 4B and 4D illustrate side views of the top mounting bracket of FIG. 4A according to aspects of the present invention.

FIG. 4C illustrates a front side view of the top mounting bracket of FIG. 4A according to aspects of the present invention.

FIG. 4E illustrates a bottom view of the top mounting bracket of FIG. 4A according to aspects of the present invention.

FIG. 5A illustrates a top view of a bottom mounting bracket according to aspects of the present invention.

FIG. 5B illustrates a side view of the bottom mounting bracket of FIG. 5A according to aspects of the present invention.

FIGS. 5C and 5D illustrate a front view of a bottom mounting bracket according to aspects of the present invention.

DETAILED DESCRIPTION

Figure 1:
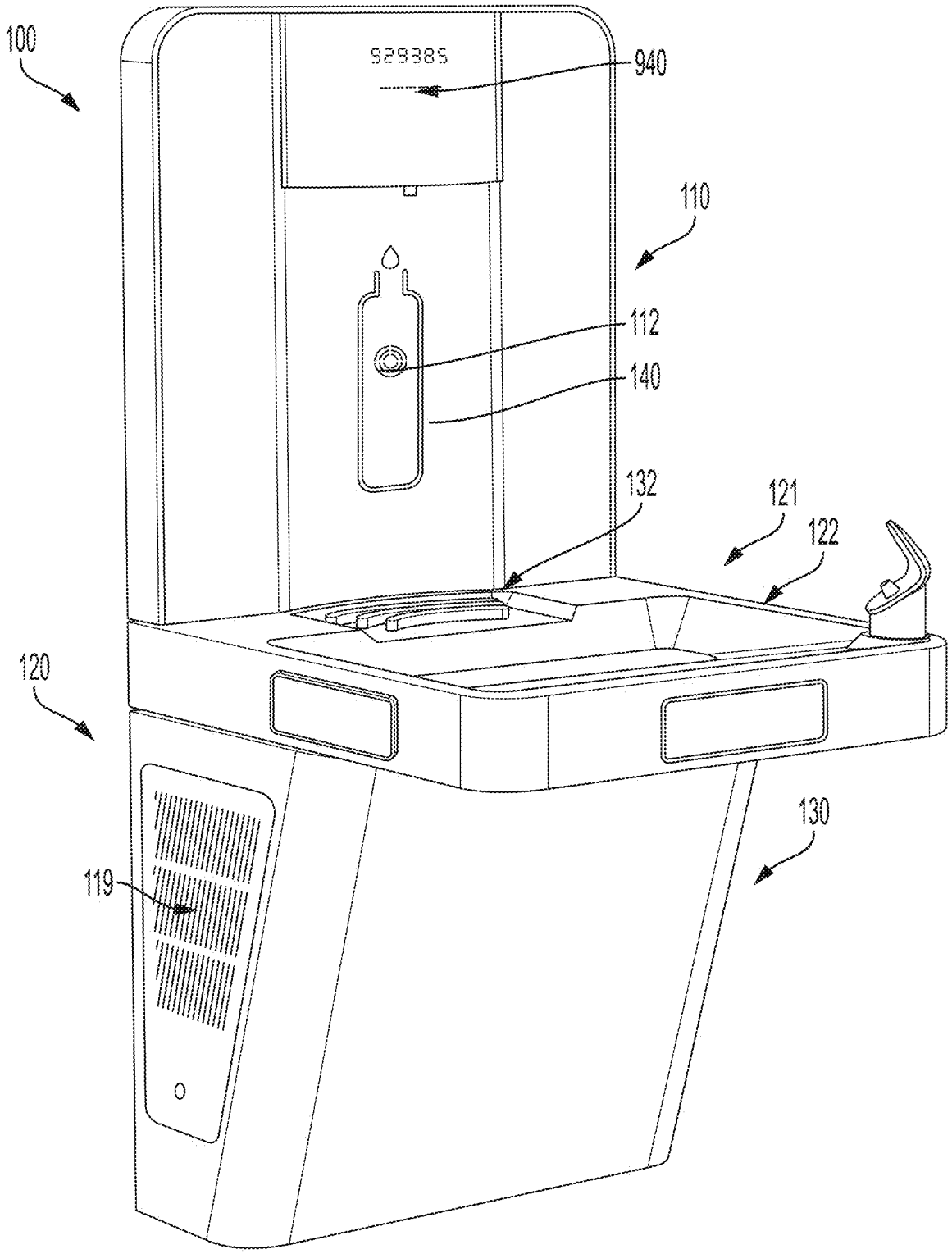
FIG. 1 is an illustration of an example bottle filling station according to aspects of the present invention.

An example bottle filling station or liquid dispenser station 100 is illustrate din FIG. 1. The bottle filling station 100 may include a liquid dispenser or bottle filler 110 configured to dispense liquid. A drinking fountain 120 may be disposed below the liquid dispenser 110.

A pan 121 may be configured to collect at least a portion of the dispensed liquid. The pan 121 may be positioned below the liquid dispenser 110. The pan 121 may include a stainless-steel basin 122. All plumbing and chilling apparatus may be provided below the basin 122.

Figure 2:
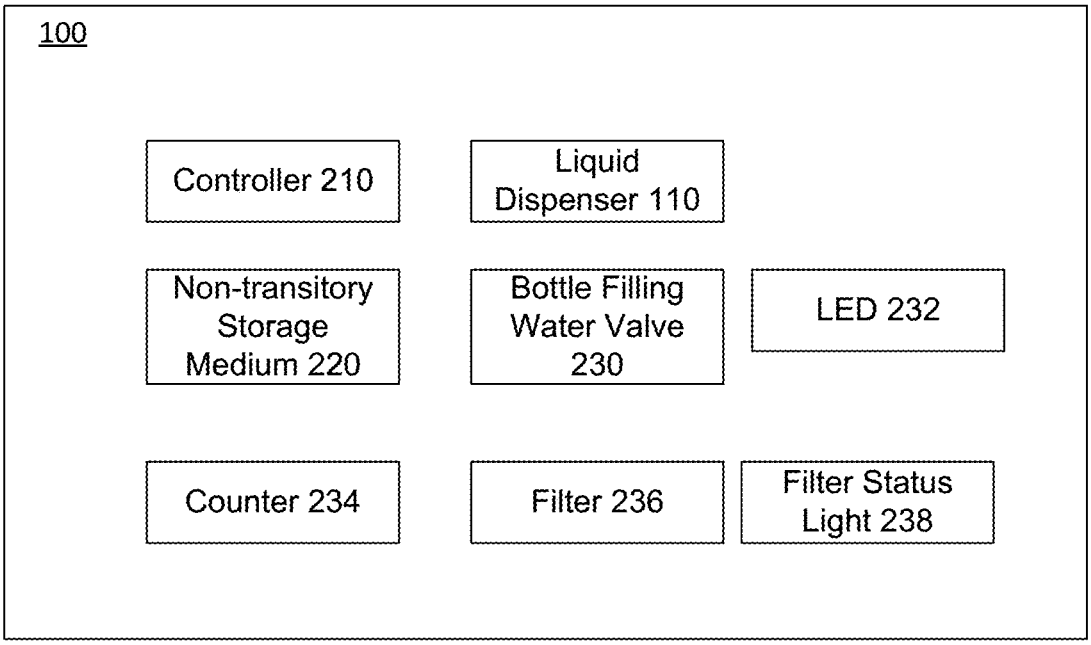
FIG. 2 is a block diagram of the example bottle filling station of FIG. 1 according to aspects of the present invention.

A sensor 112 may detect a presence of a liquid container, such as a bottle. The sensor 112 may define a height of approximately 9.25 inches relative to the pan 121. As illustrated in FIG. 2, a controller 210 may control the liquid dispenser 110 to dispense liquid when the liquid container is approximately near the sensor 112. This exemplary sensor height can reduce false-positive indications, which would dispense liquid without a bottle present. This height also forces the user to place the bottle closer to the dispensing spout, improving the aim of the dispensed water stream into the bottle opening, reducing wasted water.

A cooling system 130 may be located below the liquid dispenser 110. The cooling system 130 may include three concentric raised arcs 132 to support the liquid container when at rest, and to act as veins to direct spilled water into the basin 122.

The sensor 112 may include an infrared (IR) sensor for detecting the presence of the liquid container. The IR sensor may include at least one of an IR photodiode, an IR light emitting diode (LED), and associated electrical circuitry for receiving IR signals from the IR photodiode and transmitting light from the IR LED. Control of the IR sensor may be software based.

The IR sensor may detect the presence of the liquid container. For example, a first, environmental IR signal may be received from the IR photodiode while the IR LED is not transmitting light. A second, detection signal may be received from the IR photodiode while the IR LED is transmitting light. An intensity of the first, environmental IR signal may be compared to an intensity of the second, detection signal to determine whether the second, detection signal is emitted from the environment or is reflected from the liquid container. The detection process may be completed in less than one second. The detection process may cycle repeatedly.

In one embodiment, control of the IR sensor software may not include an automatically adjustable threshold to detect an excessive bottle movement. Detection of the bottle may be binary. If the bottle is detected, and the bottle is moved but the bottle is still positioned to reflect the IR signal transmitted from the IR LED with sufficient intensity, then there may be no change in the bottle detection as a result of the movement.

As illustrated in FIG. 2, the bottle filling station 100 may include a non-transitory storage medium 220 configured to store a sensitivity level. The sensitivity level may be manually set via a setting menu to a value between 1 and 10. A value of 1 may indicate highest sensitivity, while a value of 10 may indicate least sensitivity. A more sensitive sensitivity level may result in the bottle filling station 100 determining a bottle is present based on a smaller difference between the compared environmental IR signal intensity and the detection IR signal intensity. In one embodiment, the sensitivity setting may not update automatically. Any adjustments to the sensitivity setting may be performed by a professional during installation or maintenance. An improperly set sensitivity setting may cause the bottle filling station 100 to have unstable operation.

The sensor 112 may detect the presence of the liquid container based on a first difference between the intensity of the first, environmental IR signal and the intensity of the second, detection signal when the sensitivity level has a first value. The sensor 112 may detect the presence of the liquid container based on a second difference between the intensity of the first, environmental IR signal and the intensity of the second, detection signal when the sensitivity level has a second value. The first value may be less than the second value. The first difference may be less than the second difference.

In one embodiment, once the liquid container is detected, the sensor 112 may not change a detection result even if the liquid container moves within a sight of the sensor 112 such that the liquid container is still positioned to reflect the IR signal transmitted from the IR LED with a sufficient intensity.

In one embodiment, the sensor 112 may complete detection of the liquid container within one second from a moment that the liquid container becomes present.

In one embodiment, the sensor 112 may repeatedly perform detection.

The controller 210 may be configured to continuously generate a zero-level signal value corresponding to a clear field of view for the sensor 112. The controller 210 may calculate the zero-level signal value from multiple readings of the sensor 112.

The controller 210 may open and close a bottle filling water valve 230 based on the detection by the sensor 112.

An LED 232 may become activated by the controller 210 to illuminate a bottle filling area 140, when the bottle filling water valve 230 is open. The bottle filling area 140 may illustrate a bottle with shoulders and a neck, a large drop falling into a mouth of the bottle, and a bullseye type target for where the IR beam is transmitted or where the sensor 112 is positioned.

A counter 234 may be configured to track and display a number of theoretical bottles saved from being landfilled by refilling at the bottle filling station 100. The counter 234 may be based on quantity of liquid that flows through the bottle filling station 100. For example, the counter 234 may increment when every 16 oz of liquid has flowed through the bottle filling station 100. In another example, the counter 234 may increase after a predetermined amount of time has passed either as the cumulated time liquid is flowing, or just the general passage of time.

The bottle filling station 100 may include a filter 236 where the liquid to be dispensed passes therethrough. The filter 236 may be removable. The filter 236 may be disposable and replaceable. The water supply to both the cooling system 130 and the liquid dispenser 110 may pass through the filter 236. A filter status light 238, 940 may indicate a status of the filter 236. The filter status light 238, 940 may begin to flash once the status of the filter 236 drops below a preset threshold. The filter status light 238, 940 may include a plurality of LED lights. Each of the plurality of LED lights may correspond to a preset filter status threshold. As the filter 236 reaches each of the individual preset filter status thresholds, the corresponding LED light can at least one of change color, flash, or shut off.

The bottle filling station 100 may be assembled by a modular assembly. For example, a first module may include the cooling system 130. A second module may include an assembly having the pan 121 and the liquid dispenser 110. The first module and the second module may include a first attachment and a second attachment respectively for coupling to each other during installation. This modular assembly can also allow the three components (cooler, bottle filler and pan assembly) to be assembled prior to installation on the wall. Once the components are assembled, the entire set of components can be mounted at once. This allows the dispenser to be assembled away from the traffic areas where a fountain is typically mounted and just hung. This minimizes the disruption and interference when the dispenser is installed.

Figure 3:
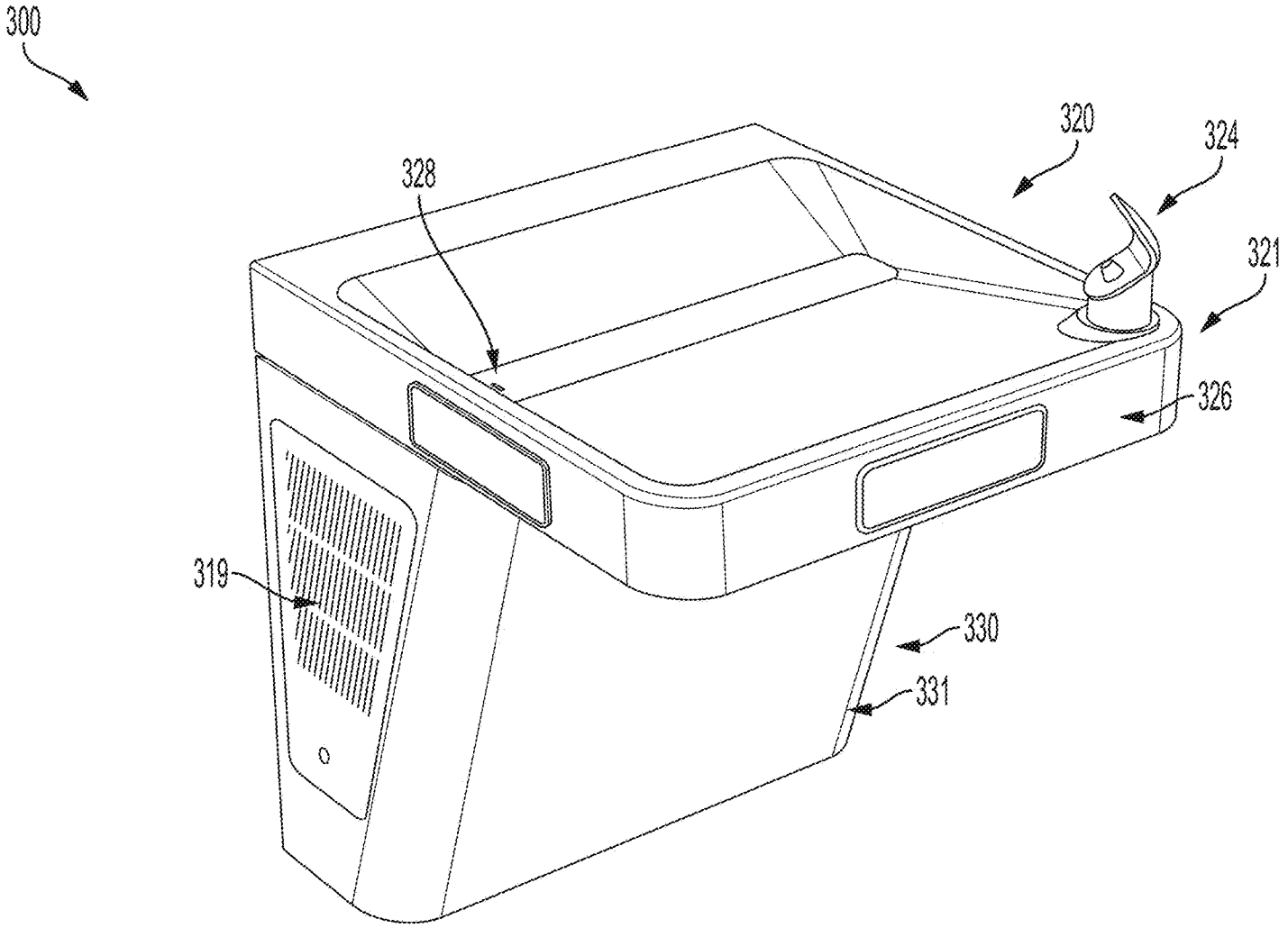
FIG. 3 is an illustration of an example liquid dispenser station according to aspects of the present invention.
Figures 4F, 4G:
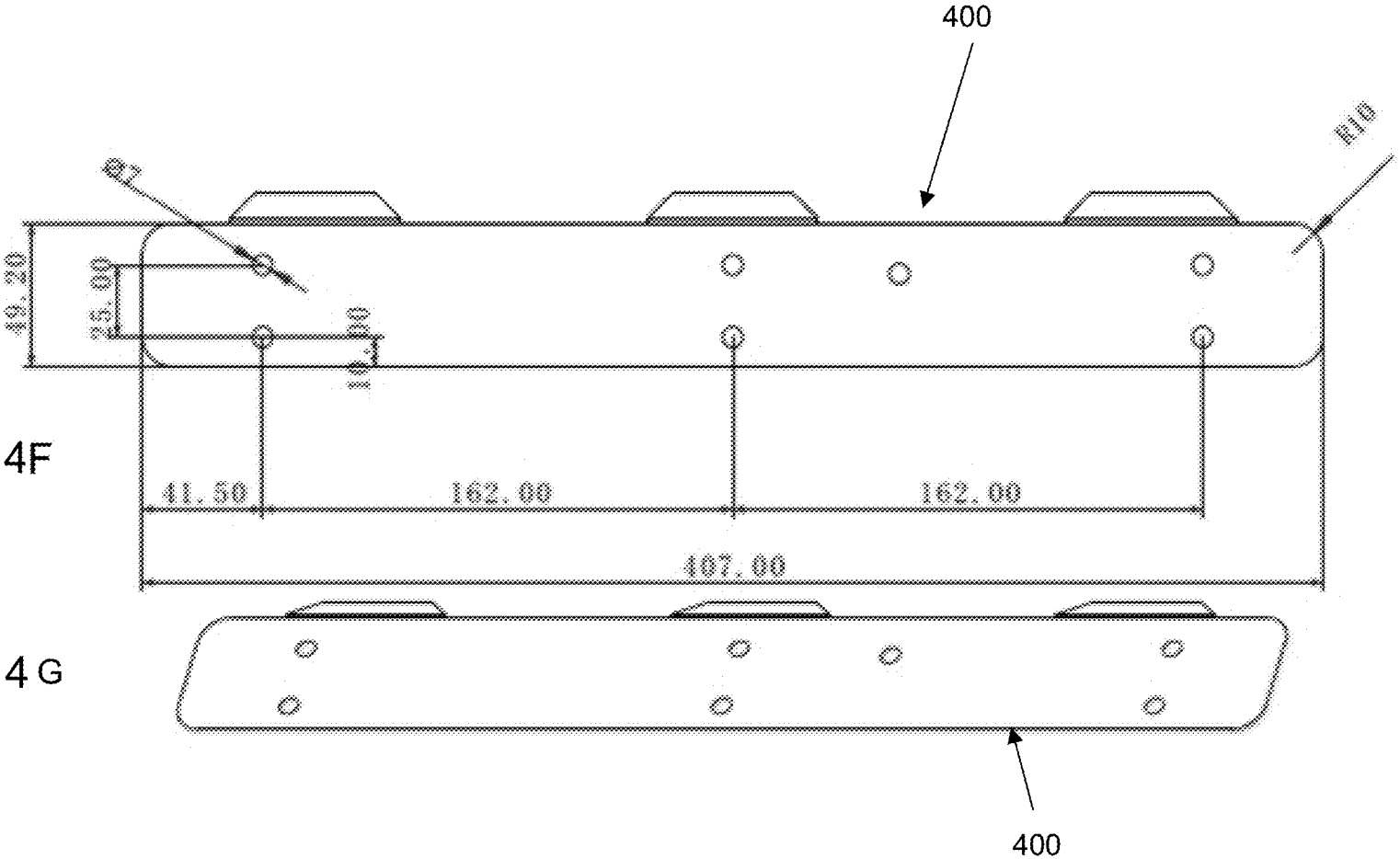
FIG. 4F illustrates a back side view of the top mounting bracket of FIG. 4A according to aspects of the present invention.
FIG. 4G illustrates a perspective view of the top mounting bracket of FIG. 4A according to aspects of the present invention.
Figure 5D:
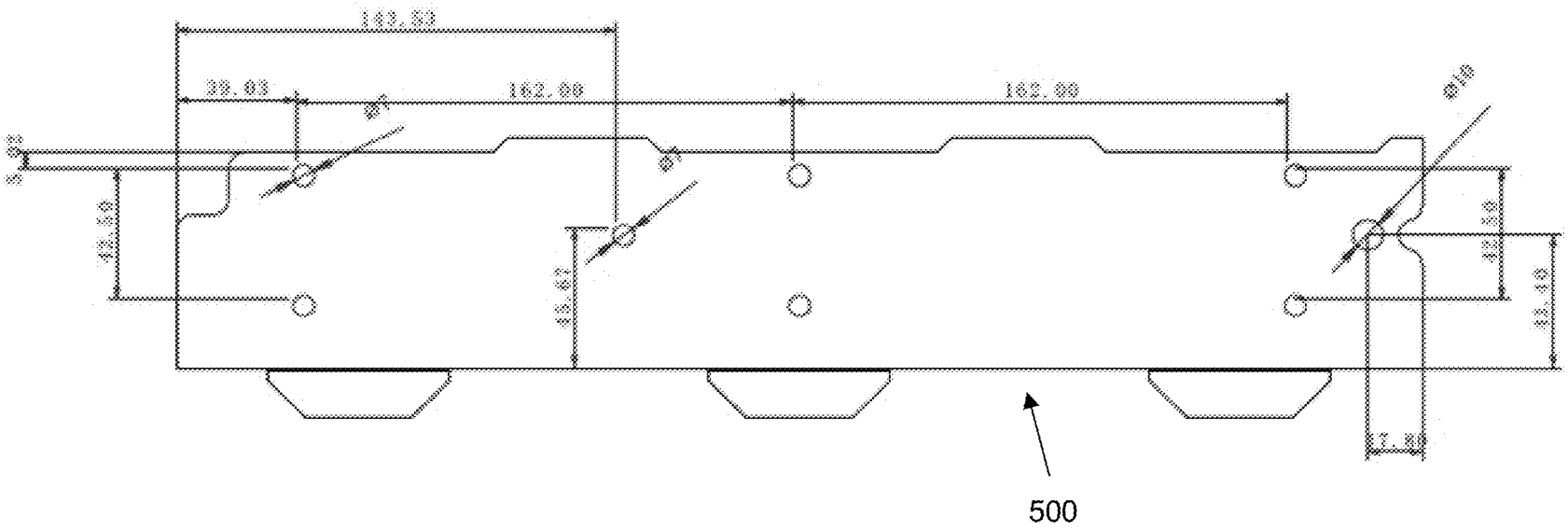
Figure 5E:
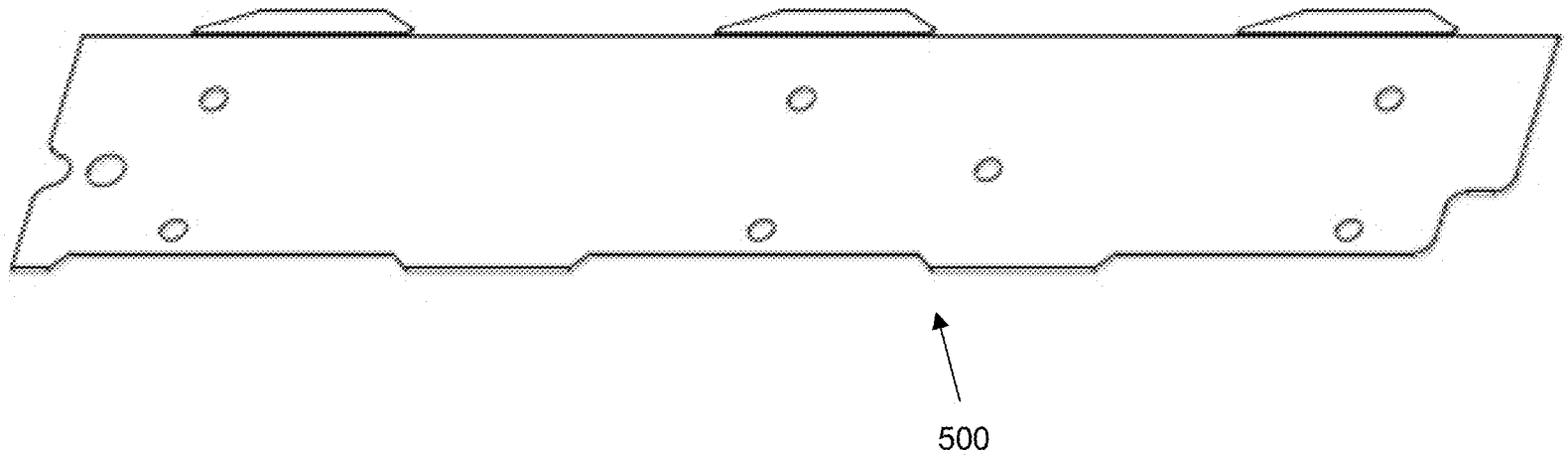
FIG. 5E illustrates a perspective view of the bottom mounting bracket of FIG. 5A according to aspects of the present invention.

FIG. 3 illustrates another example liquid dispenser station 300, including a drinking fountain 320. The drinking fountain 320 may be assembled by a modular assembly. For example, a first module may include a cooling system 330. A second module may include a pan assembly 321. The first module and the second module may include a first attachment and a second attachment respectively for coupling to each other during installation.

The cooling system 330 may include a stainless steel, lower container 331. The cooling system 330 may be positioned below the pan assembly 321 when installed. The pan assembly 321 may include a hood 324. The hood 324 may include a semi-pliant material deformable on contact. The hood 324 may include an anti-microbial material.

The lower container 331 may enclose an interior volume, and an access door 119, 319, disposed in the lower container 331. The access door may have an open position that allows access to the interior volume. A DC power supply 702 powering the bottle filling station 100 and the cooling system 330 may be disposed in the interior volume.

Further, the filter 236, where the liquid to be dispensed passes therethrough, may be disposed in the interior volume. When the access door 119, 319 is in the open position, a user can access the DC power supply 702 (see FIG. 7) and the filter 236. A remainder of the lower container 331 may remain in place while at least one of the DC power supply 702 and the filter 236 is accessed through the access door 119, 319. The lower container 331 may comprise three faces. The access door 119, 319 may be disposed in at least one of the three faces.

While the lower container 331 can be stainless steel, other examples can from it from high impact polymers. These polymers can withstand impacts without denting and have a surface that is more resistant to paint. Both features help make the dispenser 100, 300 more vandal resistant.

The pan assembly 321 may include a stainless-steel basin 326. The pan assembly 321 may define a flat sloping pan shape. The pan assembly 321 may include a drain 328.

Both of the liquid dispenser stations 100, 300 may include an access door 119, 319. This door allows access to the interior of the dispenser stations 100, 300 to replace the filter 236, change to programing through the controller 210 and can provide internal access to electrical and plumbing elements. Use of the access door 119, 319 replaces the need to remove the entire lower container 331 as is typical in the prior art.

Any of the liquid dispenser stations 100, 300 may include a mounting mechanism for securely engaging the liquid dispenser station to a wall. The mounting mechanism may include a top mounting bracket 400 as illustrated in FIGS. 4A-G. The top mounting bracket 400 may define a first height H1 and a plurality of first holes 410. The top mounting bracket 400 may include at least one top flange 412.

Referring to FIGS. 5A-E, a bottom mounting bracket 500 may define a second height H2 and a plurality of second holes 510. The bottom mounting bracket 500 may include at least one bottom flange 512. The drinking fountain 120, 320 may be configured to be secured to a wall by the top flange 412 and the bottom flange 512.

The second height H2 may be different from the first height H1. In one embodiment, the first height H1 may be less than the second height H2. Differential heights H1, H2 between the bottom and top mounting brackets may facilitate an installation process of the drinking fountain 120, 320, to avoid an installer's back injuries.

In one embodiment, the top mounting bracket 400 may include three top flanges 412, and the bottom mounting bracket 500 may include three bottom flanges 512. The top flanges 412 may be lined up to the holes and dropped down. The drinking fountain 120, 320 may be hanging by the flanges on the mounting bracket. The bottom flanges 412 may be lined up to the holes and dropped down. The drinking fountain 120, 320 may be hanging by the flanges on the mounting bracket.

Figure 6:
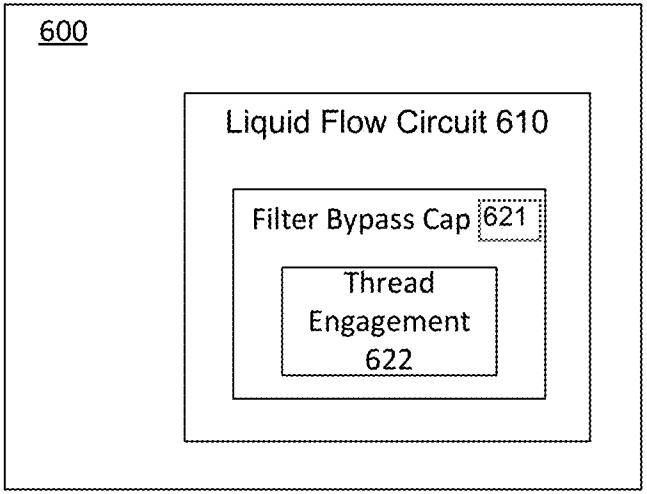
FIG. 6 illustrates a block diagram of a liquid dispenser station according to aspects of the present invention.

FIG. 6 illustrates another embodiment of a liquid dispenser station 600. The liquid dispenser station 600 may include a liquid flow circuit 610. A non-filtering bypass 620 may be disposed in the liquid flow circuit 610 at or around a filter's position. A liquid flow circuit 610 take liquid from a source and provides it to the bottle filling station 100. The source can be municipal or a fixed bottle. When the filter is removed or screwed off the non-filtering bypass 620 can allow liquid to be dispensed without filtering. The bypass 620 can be triggered automatically or require physical intervention by a use to switch it over.

In one example, the bypass 620 can be affected with a non-filtering bypass cap 621 that may have a physical dimension identical to that of the filter. Both the filter and non-filtering bypass cap 621 can be engaged by numerous means know in the art. For example, the non-filtering bypass cap 621 may have male/female threads to be screwed into the liquid flow circuit 610. The non-filtering bypass cap 621 may be removably attached to the liquid flow circuit 610 via a thread engagement 622. The non-filtering bypass cap 621 may be configured to allow liquid to flow therethrough. The non-filtering bypass cap 621 may replace the filter 236 to allow the liquid to be dispensed to pass therethrough.

In one embodiment, the non-filtering bypass cap 621 may be devoid of a radio-frequency identification (RFID) tag.

Figure 7:
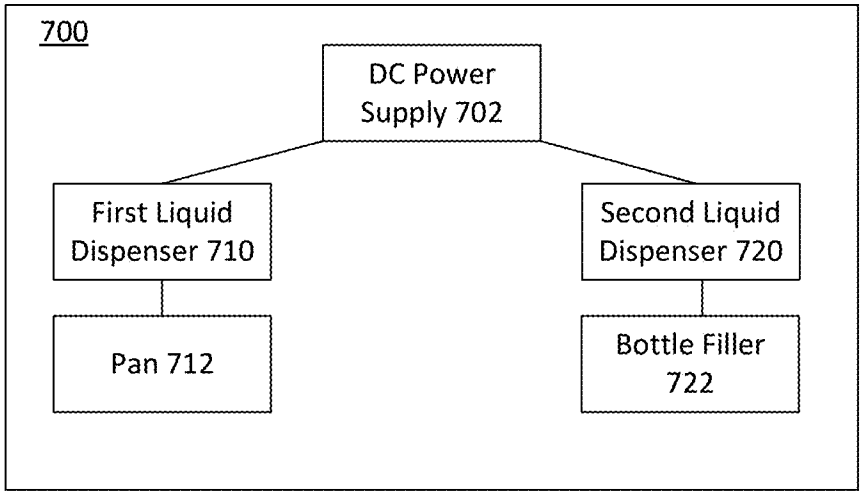
FIG. 7 illustrates a block diagram of another liquid dispenser station according to aspects of the present invention.

FIG. 7 illustrates yet another embodiment of a liquid dispenser station 700. The liquid dispenser station 700 may include a single DC power supply 702. Both a first liquid dispenser 710 and a second liquid dispenser 720 may be powered by the single DC power supply 702. A pan may be coupled to the first liquid dispenser 710. A bottle filler 722 may be coupled to the second liquid dispenser 720. The DC power supply 702 may step down an AC power supply. The DC power supply 702 can be a step-down transformer, allowing the AC wall current to be converted to low voltage DC to use less power in operation while still powering both liquid dispensers 710,720.

In one embodiment, the first liquid dispenser 710 may be a cooling station, and the second liquid dispenser 720 may be a bottle filling station. In one embodiment, the DC power supply 702 may be modular, allowing either of the bottler filling station and the cooling station to be added or removed from the DC power supply 702 without disrupting the power supply to the other.

The DC power supply 702, powering the bottle filling station and cooling station, may be disposed in the interior volume of the lower container 331.

An additional example has the DC power supply 702 and the liquid dispensers 710,720 as three separate components. Thus, the same power supply can power the coolers for both the bottle filler and standard fountain, an example of which is the bottle filling station 100. This modular design allows a user to purchase drinking fountain 320 and then add on the bottle filler 110 and both will use the same power supply, removing the need for a second power source or outlet for the second source.

Figure 8:
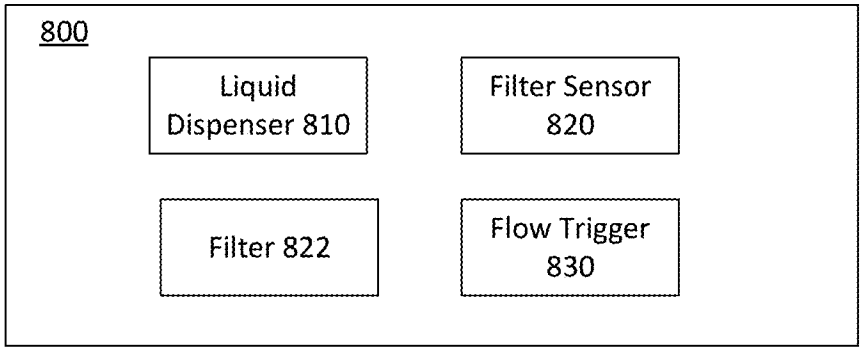
FIG. 8 illustrates a block diagram of yet another liquid dispenser station according to aspects of the present invention.

FIG. 8 illustrates a further embodiment of a liquid dispenser station 800. The liquid dispenser station 800 may include a liquid dispenser 810 for dispensing liquid. A filter sensor 820 may be in fluid communication with the liquid dispenser 810. The filter sensor 820 may be configured to track an amount of the liquid that has passed through a filter 822. A flow trigger 830 may activate the liquid dispenser 810 to dispense the liquid. The flow trigger 830 may indicate a usage of the filter 822. In one embodiment, the status of the filter 822 may be determined from a number of times the flow trigger 830 is activated. Here, the liquid dispenser station 800 may be a bottle filling station 100 as illustrated in FIG. 1 or a liquid dispenser station 300 without a bottle filler as illustrated in FIG. 3.

Figure 9:
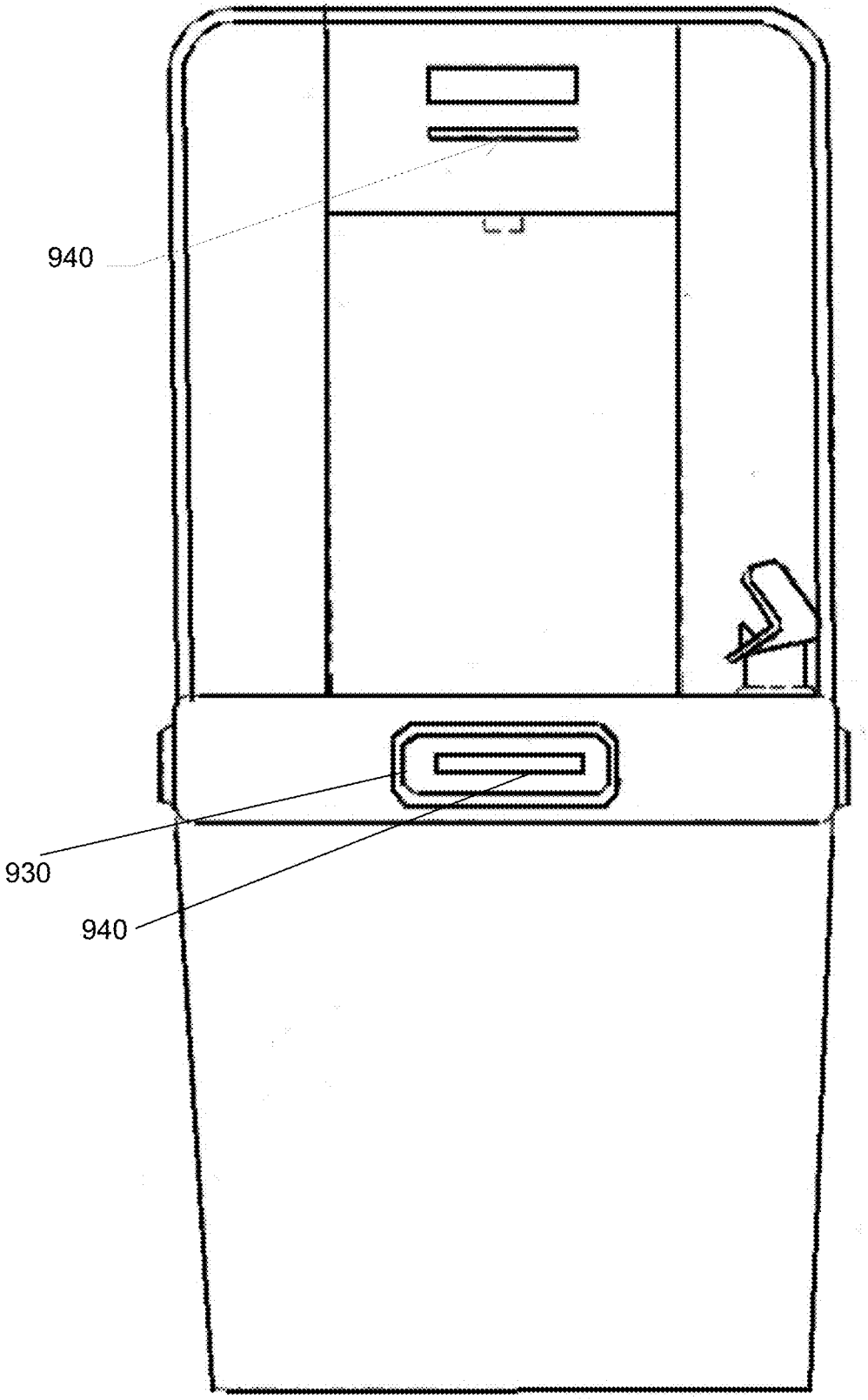
FIG. 9 illustrates an example implementation of a flow trigger according to aspects of the present invention.

As illustrated in FIG. 9, the flow trigger 830 may have at least one of the following configurations: a bumper button 930, a push bar 930, and a valve button 930. The flow trigger 830 may include a filter meter 940 or an LCD display 940 displaying the usage of the filter. In one example, the LCD display 940 may use five colors to indicate the usage of the filter 822.

The filter 822 may be configured to remove or reduce at least one of the following: chlorine, odors, lead and cysts. The filter 822 may be NSF/ANSI 42 and 53 complaint. The filter 822 may have a unique threading engagement customized for individual manufactures. The filter 822 may be configured to perform a maximum of 3000-gallon filter cycles.

The flow meter 940 or the LCD display may update the usage of the filter based on the time from the installation of a new filter, such as ticking down in increments until the filter is fully expired in a predetermined amount of time. In one embodiment, the usage of the filter 822 may be determined based on a length of time of using the filter. The filter 822 may have a life term of 90 days.

Figure 10:
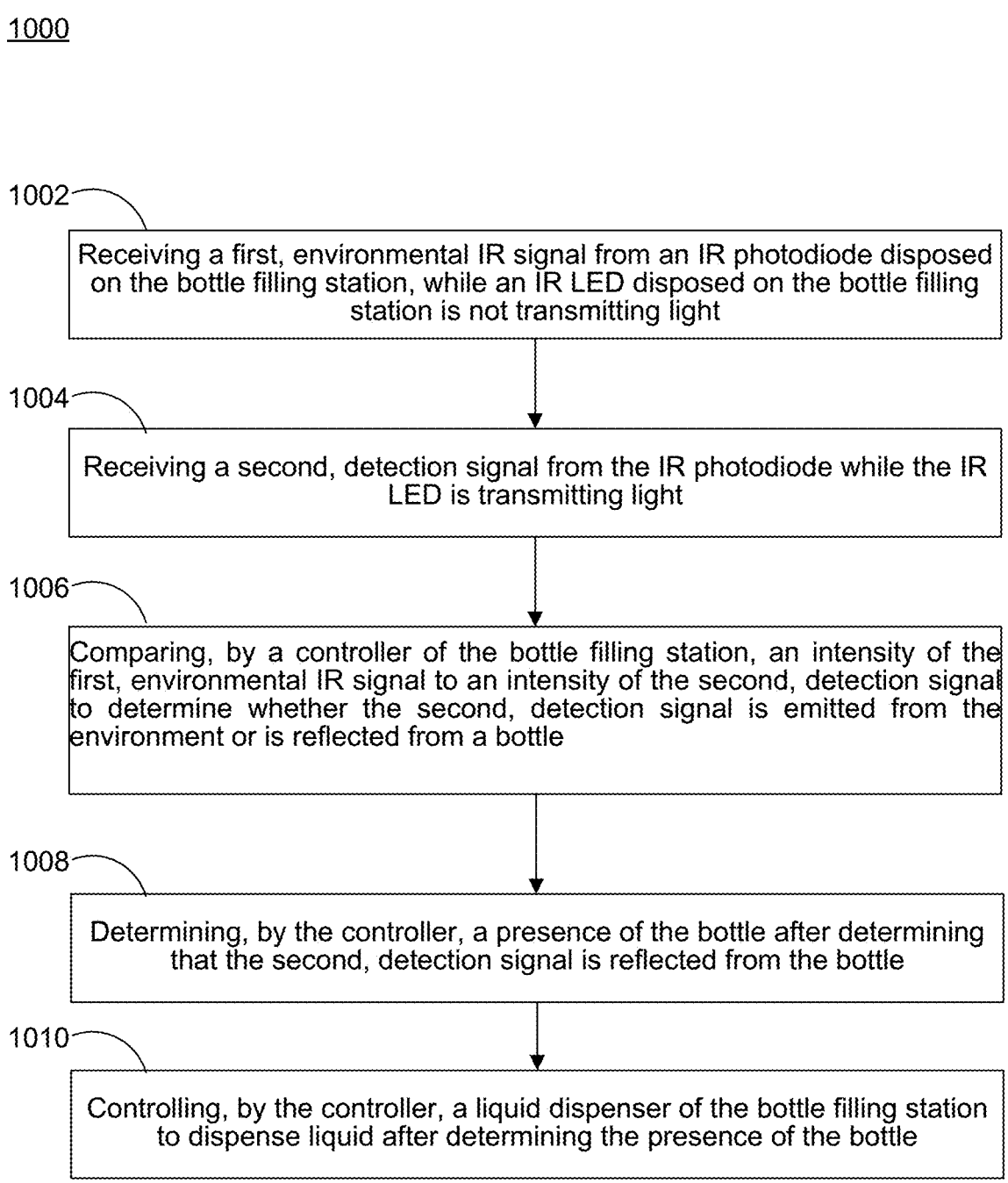
FIG. 10 is a flow chart illustrating steps for detecting a presence of a liquid container by a bottle filling station according to aspects of the present invention.

FIG. 10 is a flow diagram illustrating an example method 1000 for detecting a presence of a liquid container by the bottle filling station 100. At 1002, a first, environmental IR signal may be received from an IR photodiode disposed on the bottle filling station 100, while an IR LED disposed on the bottle filling station 100 is not transmitting light. At 1004, a second, detection signal may be received from the IR photodiode while the IR LED is transmitting light. The controller 210 of the bottle filling station 100 may compare an intensity of the first, environmental IR signal to an intensity of the second, detection signal to determine whether the second, detection signal is emitted from the environment or is reflected from a bottle. The controller 210 may determine a presence of the bottle after determining that the second, detection signal is reflected from the bottle. The controller 210 may control the liquid dispenser 110 of the bottle filling station 100 to dispense liquid after determining the presence of the bottle.

The descriptions contained herein are examples of embodiments of the invention and are not intended in any way to limit the scope of the invention. As described herein, the invention contemplates many variations and modifications of the insertion apparatus. These modifications would be apparent to those having ordinary skill in the art to which this invention relates and are intended to be within the scope of the claims which follow.

The below are also aspects of the invention.

1. A liquid dispenser station comprising:

a top mounting bracket defining a first height and defining a plurality of first holes, the top mounting bracket including at least one top flange;

a bottom mounting bracket defining a second height and defining a plurality of second holes, the bottom mounting bracket including at least one bottom flange, wherein the second height is different from the first height; and a drinking fountain configured to be secured to a wall by the top flange and the bottom flange.

2. The liquid dispenser station of aspect 1, wherein the first height is less than the second height.
3. The liquid dispenser station of aspect 1, wherein the top mounting bracket includes three top flanges, and the bottom mounting bracket includes three bottom flanges.
4. A bottle filling station comprising:

a liquid dispenser configured to dispense liquid;

a pan configured to collect at least a portion of the dispensed liquid;

a sensor detecting a presence of a liquid container, the sensor defining a height of approximately 9.25 inches relative to the pan; and a controller controlling the liquid dispenser to dispense liquid when the liquid container is approximately near the sensor.

5. The bottle filling station of aspect 4, wherein the pan is positioned below the liquid dispenser.
6. The bottle filling station of aspect 4, further comprising a cooling system located below the liquid dispenser.

7. The bottle filling station of aspect 4, wherein the pan includes a stainless-steel basin.
8. The bottle filling station of aspect 7, wherein the cooling system comprises three raised arcs to support the liquid container when at rest, and direct spilled water into the basin.
9. The bottle filling station of aspect 4, further comprising a DC power supply providing power to the bottle filling station.
10. The bottle filling station of aspect 6, further comprising a DC power supply providing power to the bottle filling station and the cooling station.
11. The bottle filling station of aspect 9, wherein the DC power supply steps down an AC power supply.
12. The bottle filling station of aspect 10 wherein the DC power supply is modular, allowing either of the bottler filling station and the cooling station to be added or removed from the DC power supply without disrupting the power supply to the other.
13. The bottle filling station of aspect 4, wherein the sensor completes detection of the liquid container within one second from a moment that the liquid container becomes present.
14. The bottle filling station of aspect 4, wherein the sensor repeatedly performs detection.
15. The bottle filling station of aspect 4, wherein the controller opens and closes a bottle filling water valve based on the detection by the sensor.
16. The bottle filling station of aspect 15, further comprising an LED activated to illuminate a bottle filling area, when the bottle filling water valve is open.
17. The bottle filling station of aspect 6, wherein the cooling station comprises:

a lower container enclosing an interior volume, and an access door, disposed in the lower container, comprising an open position that allows access to the interior volume.

18. The bottle filling station of aspect 17, further comprising:

a DC power supply powering the bottle filling station and cooling station, disposed in the interior volume; and a filter where the liquid to be dispensed passes therethrough, disposed in the interior volume;

wherein when the access door is in the open position a user can access the DC power supply and the filter, and wherein a remainder of the lower container remains in place while at least one of the DC power supply and the filter is accessed through the access door.

19. The bottle filling station of aspect 18, wherein the lower container comprises three faces and the access door can be disposed in at least one of the three faces.
20. The bottle filling station of aspect 4, further comprising a filter where the liquid to be dispensed passes therethrough.
21. The bottle filling station of aspect 20, further comprising a filter status light indicating a status of the filter.
22. The bottle filling station of aspect 20, wherein the filter is removable, and further comprising a non-filtering bypass cap that can replace the filter to allow the liquid to be dispensed to pass therethrough.

23. The bottler filling station of aspect 20, wherein the cooling station further comprises a bubbler having a flow trigger;

wherein the status of the filter is determined from a number of times the flow trigger is activated.

24. The bottle filling station of aspect 21, wherein the filter status light begins to flash once the status of the filter drops below a preset threshold.
25. The bottle filling station of aspect 21, wherein the filter status light comprises a plurality of LED lights, wherein each of the plurality of LED lights corresponds to a preset filter status threshold, and wherein as the filter reaches each of the individual preset filter status thresholds, the corresponding LED light can at least one of change color, flash, or shut off.

26. A modular assembly of a drinking fountain, comprising:

a first module including a cooling system; and a second module including a pan assembly, wherein the first module and the second module include a first attachment and a second attachment respectively for coupling to each other during installation.

27. The modular assembly of aspect 26, wherein the cooling system comprises a stainless steel container.
28. The modular assembly of aspect 26, wherein the cooling system is positioned below the pan assembly when installed.
29. The modular assembly of aspect 26, wherein the pan assembly includes a hood, and the hood includes a semi-pliant material deformable on contact.
30. The modular assembly of aspect 26, wherein the pan assembly comprises a stainless-steel basin.
31. The modular assembly of aspect 26, wherein the pan assembly defines a flat sloping pan shape.
32. The modular assembly of aspect 26, wherein the pan assembly comprises a drain.
33. A liquid dispenser station comprising:

a liquid dispenser for dispensing liquid;

a filter sensor, in fluid communication with the liquid dispenser, configured to track an amount of the liquid that has passed through a filter; and a flow trigger activating the liquid dispenser to dispense the liquid, and indicating a usage of the filter.

34. The liquid dispenser station of aspect 33, wherein the flow trigger has at least one of the following configurations: a bumper button, a push bar, and a valve button.
35. The liquid dispenser station of aspect 33, wherein the flow trigger comprises a filter meter displaying the usage of the filter.
36. The liquid dispenser station of aspect 33, wherein the flow trigger comprises an LCD display that uses five colors to indicate the usage of the filter.
37. The liquid dispenser of aspect 33, wherein the filter has a unique engagement threading.
38. The liquid dispenser of aspect 33, wherein the filter is configured to perform a maximum of 3000-gallon filter cycles.
39. The liquid dispenser of aspect 33, wherein the usage of the filter is determined based on a length of time of using the filter.
40. The liquid dispenser of aspect 33, wherein the filter has a life term of 90 days.
41. A method for detecting a presence of a liquid container by a bottle filling station, comprising:

receiving a first, environmental IR signal from an IR photodiode disposed on the bottle filling station, while an IR LED disposed on the bottle filling station is not transmitting light;

receiving a second, detection signal from the IR photodiode while the IR LED is transmitting light;

comparing, by a controller of the bottle filling station, an intensity of the first, environmental IR signal to an intensity of the second, detection signal to determine whether the second, detection signal is emitted from the environment or is reflected from a bottle;

determining, by the controller, a presence of the bottle after determining that the second, detection signal is reflected from the bottle; and controlling, by the controller, a liquid dispenser of the bottle filling station to dispense liquid after determining the presence of the bottle.

What we claim is:

1. A bottle filling station comprising:

a liquid dispenser configured to dispense liquid;

a pan configured to collect at least a portion of the dispensed liquid;

a liquid flow circuit providing liquid to the liquid dispenser;

a filter removably disposed in the liquid flow circuit configured to filter the liquid in the liquid circuit; and a non-filtering bypass to provide liquid to the liquid dispenser bypassing the filter, comprising a non-filtering bypass cap that can replace the filter to allow the liquid to be dispensed to pass therethrough, wherein the liquid flow circuit comprises an engagement to allow the filter to be removable;

wherein the non-filtering bypass cap can also be removably engaged to the engagement in lieu of the filter; and wherein the non-filtering bypass cap comprises physical dimensions that are similar to physical dimensions of the filter.

2. The bottle filling station of claim 1, further comprising:

a lower container enclosing an interior volume, and an access door, disposed in the lower container, comprising an open position that allows access to the interior volume, wherein at least one of the filter and the non-filtering bypass cap can be accessed through the access door.

* * * * *